US005613394A

United States Patent [19]

Kawamura et al.

[11] Patent Number: 5,613,394

[45] Date of Patent: Mar. 25, 1997

[54] METHOD AND APPARATUS FOR FILLING AND DISCHARGING A FILLING MATERIAL

[75] Inventors: Yoshiro Kawamura; Tadayuki Matsuda, both of Kumamoto-ken, Japan

[73] Assignee: Honda Giken Kogyo Kabushiki Kaisha, Tokyo, Japan

[21] Appl. No.: 282,569

[22] Filed: Jul. 29, 1994

[30] Foreign Application Priority Data

Jul. 30, 1993 [JP] Japan ..... 5-208803
Jul. 30, 1993 [JP] Japan ..... 5-208804

[51] Int. Cl.[6] ..... B21D 9/16

[52] U.S. Cl. ..... 72/369; 29/530

[58] Field of Search ..... 72/369, 370; 29/424, 29/530; 264/262, 267

[56] References Cited

U.S. PATENT DOCUMENTS 4,947,537 8/1990 Lisec ..... 72/369

FOREIGN PATENT DOCUMENTS 564623 10/1944 United Kingdom .

*Primary Examiner*—Lowell A. Larson

*Attorney, Agent, or Firm*—Birch, Stewart, Kolasch & Birch, LLP

[57] ABSTRACT

A discharging furnace and a filling furnace are disposed in three dimensions in the upper and lower positions of a filling and discharging furnace. A reservoir is provided in an inclined surface protruding toward the lower filling furnace. The reservoir includes a valve operatively connected thereto. A hot blast heated by a duct heater through a duct is mainly fed into the discharging furnace for further heating, while a remaining small portion of the hot blast is fed into the filling furnace for keeping the filling furnace warm. Inside the discharging furnace, a filling material filled in a bent workpiece is molten and discharged into the reservoir and when the valve is opened, the gathered filling material is filled into the inside of the workpiece which is carried by a filling carrier. The filling carrier is divided into three portions of a filling pallet, a carrier body and a sealing pallet, wherein the filling pallet is provided with a nozzle and the sealing pallet is provided with a seal member. When the sealing pallet is moved upward, a slide deck is also moved up in a condition which the seal member is engaging with the lower end portion of the tubular workpiece, so that the tubular workpiece can engage at its top end portion with the nozzle. The filling material gathered within the filling pallet is then filled through the nozzle into the workpiece. In case the specification of the workpiece is changed, the nozzle and the seal member are replaced.

15 Claims, 12 Drawing Sheets

METHOD AND APPARATUS FOR FILLING AND DISCHARGING A FILLING MATERIAL

BACKGROUND OF THE INVENTION

1. Field of the Invention

This invention relates to a method and apparatus for filling, melting and discharging a filling material of low melting point to be used for bending a workpiece.

2. Description of Background Art

When it is required to bend a pipe having multiple pipes disposed within each other, a filling material of low melting point is supplied into the tubular workpiece to permit bending of the inner and outer pipes with accuracy. However, conventionally, the steps of filling the filling material of low melting point into a straight tubular workpiece, bending the straight tubular workpiece to form a bent tubular workpiece, and heating to melt and discharge the filling material after moving the bent tubular workpiece into a discharging furnace have been carried out at different locations.

Therefore, the filling material, when molten and discharged, is kept in a reservoir for maintaining the heat of the discharged liquid and then released from the reservoir for maintaining the heat to the next straight tubular workpiece by means of a pump.

Also, generally, the straight tubular workpiece is supported by a carrier which is provided with a nozzle adapted to engage the upper end portion of the straight tubular workpiece for supplying the filling material thereto, and a sealing member adapted to engage the lower end of the straight tubular workpiece.

SUMMARY AND OBJECTS OF THE INVENTION

According to the background art described above, since the steps required for each workpiece which undergoes the steps of filling, melting and discharging the filling material must be carried out at different locations, it is imperative to have a heat reservoir which is provided for the discharged liquid and as a whole, there is need for a considerably large working space together with a sufficient source of heat for keeping warm a sufficient quantity of filling material. Further, it takes a comparatively long time to finish a series of workpieces. It is therefore required not only to decrease the working space, but also to improve the working efficiency, by eliminating the heat sink or heat reservoir for the discharged liquid.

Still further, since the nozzle and the sealing member must be exclusively used for the specifications relative to the length and inner and outer diameters of the straight tubular workpiece, it becomes necessary to remake the carrier whenever the specifications of the straight tubular workpiece are changed and it is inconvenient. It is therefore required to cope with such a possible change of the specifications of the straight tubular workpiece in a limited way.

It is therefore an object of the present invention to provide an improved apparatus and method for filling, and melting and discharging a filling material of low melting point to be used for bending, into a workpiece to meet the above requirements.

The above and other objects of the present invention will be more apparent from the following description taken in conjunction with the accompanying drawings.

As a means to solve the above disadvantages, there is provided a method and apparatus described below.

According to the present invention, there is provided a method for filling and discharging a filling material comprising the steps of filling the filling material of low melting point into a straight tubular workpiece; bending the straight tubular workpiece to form a bent tubular workpiece; and heating to melt and discharge the filling material after moving the bent tubular workpiece into a discharging furnace; wherein there is provided a single, filling and discharging furnace having in upper and lower positions thereof a discharging furnace and a filling furnace for filling the filling material into the straight tubular workpieces, respectively. The filling material is molten and then discharged in the upper discharging furnace, and the molten and discharged filling material is gathered in a reservoir formed on the floor of the upper discharging furnace, thereby filling it into the straight tubular workpiece disposed in the lower filling furnace.

Said filling and discharging furnace includes hot air circulating equipment communicating between the discharging furnace and the filling furnace disposed in the upper and lower parts of the filling and discharging furnace, wherein the majority of the hot air is sent to the discharging furnace and the rest thereof is sent to the filling furnace, and a reservoir provided on the floor of the discharging furnace for receiving the filling material molten and discharged therein and having a valve provided at the bottom portion of the reservoir, wherein the filling material stored in the reservoir is adapted to be released through the valve into the filling furnace.

Further, the hot air circulating equipment comprises an exhaust duct of a valve-operation type adapted to release the hot air within the discharging furnace to the atmosphere, a first supply port for supplying the hot air into the discharging furnace, and a second supply port for supplying the hot air into the filling furnace, wherein the opening and closing operations of the valve of the exhaust duct can be also linked with those of doors respectively provided at the discharging furnace and the filling furnace for allowing the workpieces to go in and out thereof.

It is also possible to form the reservoir on the inclined surface of the bottom portion of the discharging furnace protruded toward the filling furnace provided thereunder.

Further, it is possible to dispose a filling carrier within the filling furnace right under the valve which is provided at the bottom portion of the reservoir. It is also to be noted that a plurality of the workpiece carriers can be accommodated at the same time within the filling furnace and the discharging furnace, respectively.

According to another aspect of the present invention, there is provided a filling carrier of a filling material for bending, which is the carrier for supporting the straight tubular workpiece prior to bending and filling the filling material into the workpiece, comprising a carrier body, a filling pallet disposed at the upper portion of the carrier body, and a sealing pallet disposed at the lower portion of the carrier body, the carrier body being provided with a slide deck adapted to move up and down in a condition vertically supporting the straight tubular workpiece, the filling pallet being in the form of an upwardly opened receptacle for holding the filling material in a molten condition and provided with a nozzle which is fixed to protrude downwardly at the periphery of a through bore formed at the bottom portion of the receptacle and which has an inner diameter substantially corresponding to an outer diameter of the straight tubular workpiece, the upper portion of which is adapted to engage with the nozzle when moved upwardly, and the sealing pallet being disposed to move up and down and provided with a seal member which has an outer diameter substantially corresponding to an inner diameter of the straight tubular workpiece, the lower portion of which is adapted to engage with the seal member when the sealing pallet is moved upwardly.

Further, this filling carrier of the filling material for bending is designed to support a plurality of the straight tubular workpieces, wherein a single filling pallet is provided with a plurality of nozzles, while a single sealing pallet is provided with a plurality of seal members, so that these nozzles and seal members may be disposed to correspond to the plurality of the straight tubular workpieces, respectively.

It is also possible to detachably support the straight tubular workpiece and the bent tubular workpiece at their peripheries to the side of the carrier by engaging members which are susceptible to elastic deformation.

The slide deck of the filling carrier is lifted as the sealing pallet is lifted, allowing the upper portion of the straight tubular workpiece to be connected to the nozzle and the opening of the lower portion thereof to be sealed with the sealing member, wherein these nozzles and sealing members may also be replaced when the specification of the straight tubular workpiece is changed.

On the other hand, the sealing pallet of the filling carrier may be lifted by a lifter provided separately from the carrier body and it may also be secured by a stopper means to the lower portion of the slide deck when lifted.

The filling pallet may be detachably secured to the carrier body by a stopper and it is provided with a detachably mounted guide pin which is adapted to engage with the inside of the upper portion of the straight tubular workpiece and which may also be disposed to be concentric with the nozzle.

According to a filling and discharging furnace of the present invention, since there is provided a single filling and discharging furnace with a discharging furnace and a filling furnace disposed at the upper and lower parts thereof, it is possible at the same time to fill a filling material as well as to melt and discharge it in the filling and discharging furnace and as a result, a heat reservoir for the discharged liquid is no longer necessary. With this, it is not only possible to reduce the working space and save the heat keeping energy for the filling material, but also to improve the working efficiency by carrying out a plurality of steps at one place. It is also possible to recycle the filling material in a minimum quantity.

If the filling furnace is heated by utilizing a part of the hot air which is mainly sent to the discharging furnace, it is also possible to save the heat keeping energy and simplify the structure of the heat keeping equipment within the filling and discharging furnace.

Also, when the opening and closing operations of a valve of an exhaust duct are linked with those of the doors respectively provided at the discharging furnace and the filling furnace for allowing the workpiece to go in and out thereof, hot air may be prevented from discharging out of the doors when the doors are opened.

If the bottom portion of the discharging furnace is formed with a slant surface, it is also possible to effect quick and sure release of the filling material.

On the other hand, when a filling carrier for filling the filling material into the straight tubular workpiece is situated within the filling furnace and right under the valve formed at the bottom portion of a reservoir, it is possible to release the filling material into the filling carrier situated in the filling furnace.

Further, if a plurality of workpiece carrying carriers are accommodated in the filling furnace and the discharging furnace at the same time, it is possible at the same time to effect the filling operation of the filling material as well as to effect the melting and discharging operations, on such a plurality of workpieces carrying carriers, thereby improving the working efficiency more.

A carrier according to the present invention is divided into three parts comprising a carrier body, a filling pallet and a sealing pallet, wherein the carrier body is provided with a slide deck adapted to move up and down while supporting a straight tubular workpiece thereon, the filling pallet is provided with a nozzle, and the sealing pallet is provided with a seal member and adapted to move up and down. When it is desired to alter a specification of the straight tubular workpiece, it is not necessary to change the carrier body, but just to change the nozzle and the seal member. Since the portion to be changed can be set as low as possible, it is possible to reduce the cost and since it is no longer necessary to keep different kinds of carriers, it is possible to reduce the stocking space.

In this case, if a plurality of the straight tubular workpieces are supported on the carrier at a time and also a plurality of nozzles and seal members are arranged to correspond to these straight tubular workpieces, it is possible to fill the filling materials into many straight tubular workpieces at a time and remarkably improve the working efficiency.

Also, when the straight tubular workpiece and a bent tubular workpiece are detachably secured at their peripheries to the sides of the carrier by engaging members which are adapted to engage with them by the elastic deformation, their attachment or detachment becomes easy and certain.

Further, when the slide deck is elevated by the elevation of the sealing pallet which is also adapted to be elevated by a lifter provided separately from the carrier body, so that the upper end portion of the straight tubular workpiece may be connected to the nozzle and the opening of the lower end portion of the straight tubular workpiece may be sealed by the seal member, it is not only possible to make the construction of the carrier simple, but also to carry out both the connecting and sealing processes of the straight tubular workpiece at the same time and reduce the number of the filling processes of the filling materials.

In this case, if the nozzle and the seal member are designed to be replaceable in response to a possible change in the specification of the straight tubular workpiece and the filling pallet is detachably secured to the carrier body by a stopper, it is possible to cope with such change of specification of the straight tubular workpiece more flexibly.

Further, if the sealing pallet is designed to be secured by a stopper means to the lower portion of the slide deck when lifted, it is possible to make the positioning of the slide deck easy and certain.

Still further, if the filling pallet is provided with a detachably mounted guide pin which is adapted to engage with the inside of the upper end portion of the straight tubular workpiece with a certain clearance formed therebetween and if the guide pin is situated concentrically with the nozzle, it is possible to make the positioning of the straight tubular workpiece and the filling pallet easy and cope with the change in specification of the straight tubular workpiece easily.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
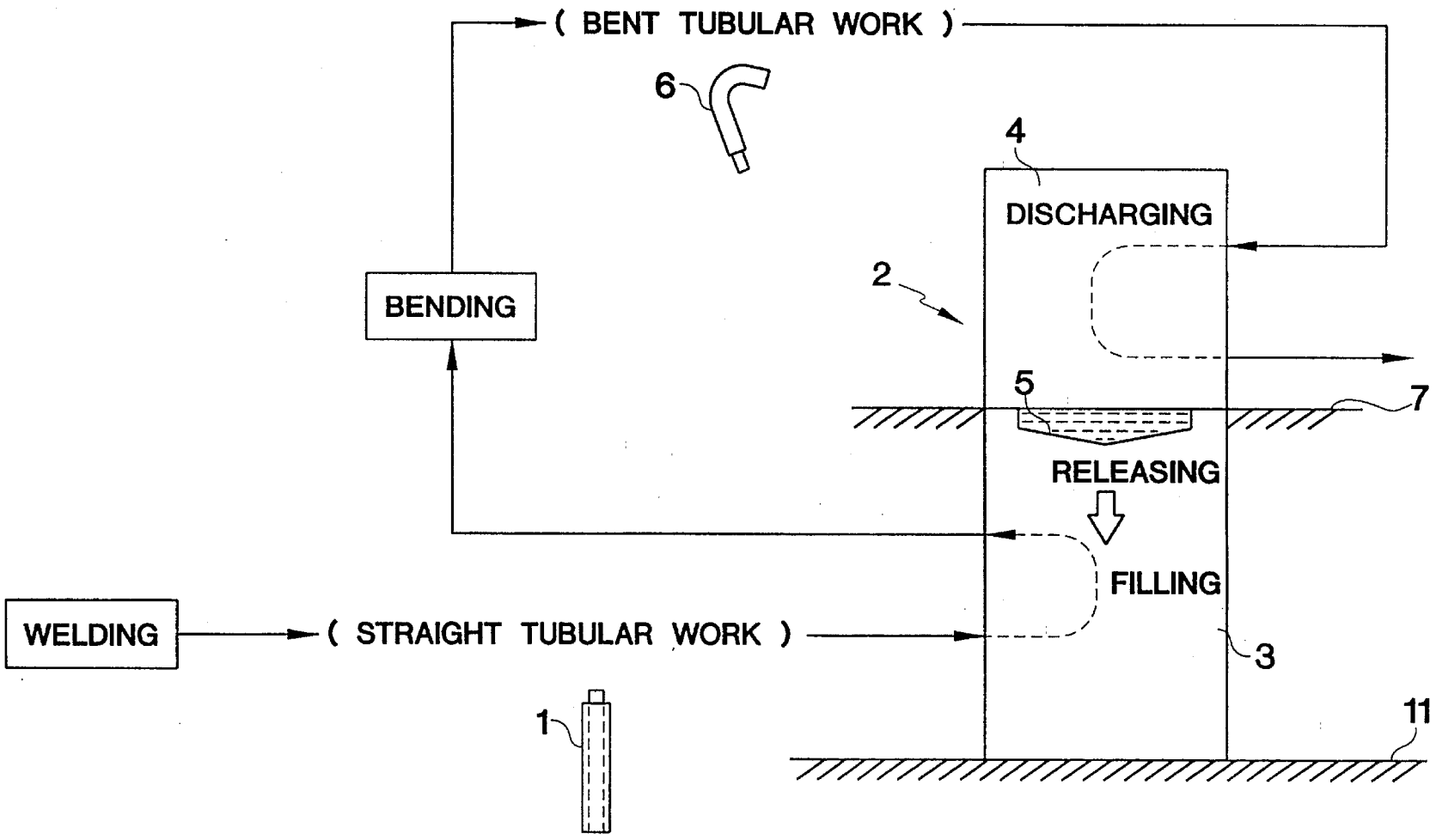
FIG. 1 illustrates a schematic view of a bending process according to a preferred embodiment of the present invention.

An embodiment of the present invention will be described with reference to the accompanying drawings. FIG. 1 illustrates a schematic view of a bending process of an exhaust pipe for a motorcycle according to the present invention. Firstly, a straight tubular workpiece 1 of double pipe construction includes inner and outer pipes formed by welding and it is entered into a filling furnace 3 which forms a lower portion of a filling and discharging furnace 2. At the same time, a bent tubular workpiece 6 which has already been bent is entered into a discharging furnace 4 which forms an upper portion of the filling and discharging furnace 2.

Secondly, when the discharging furnace 4 is heated over a melting point of a filling material, the filling material molten and discharged from the bent tubular workpiece 6 is gathered in a reservoir 5 which is formed in a floor 7 of the discharging furnace 4. The filling material in the reservoir is then used to fill the space between the inner and outer pipes of the straight tubular workpiece 1 situated within the lower filling furnace 3.

Next, the bent tubular workpiece 6, after discharging the filling material, is moved out of the discharging furnace 4 for the next process. Also, the straight tubular workpiece 1 filled with the filling material is moved out of the filling furnace 3 for the next bending process. In this case, since the straight tubular workpiece 1 is filled with the filling material, it is possible to carry out each bending step for the inner and outer pipes of the workpiece accurately so as to form a bent tubular workpiece 6. The bent tubular workpiece 6 is then moved into the discharging furnace 4 wherein the filling material is molten and discharged as described above.

Figure 2:
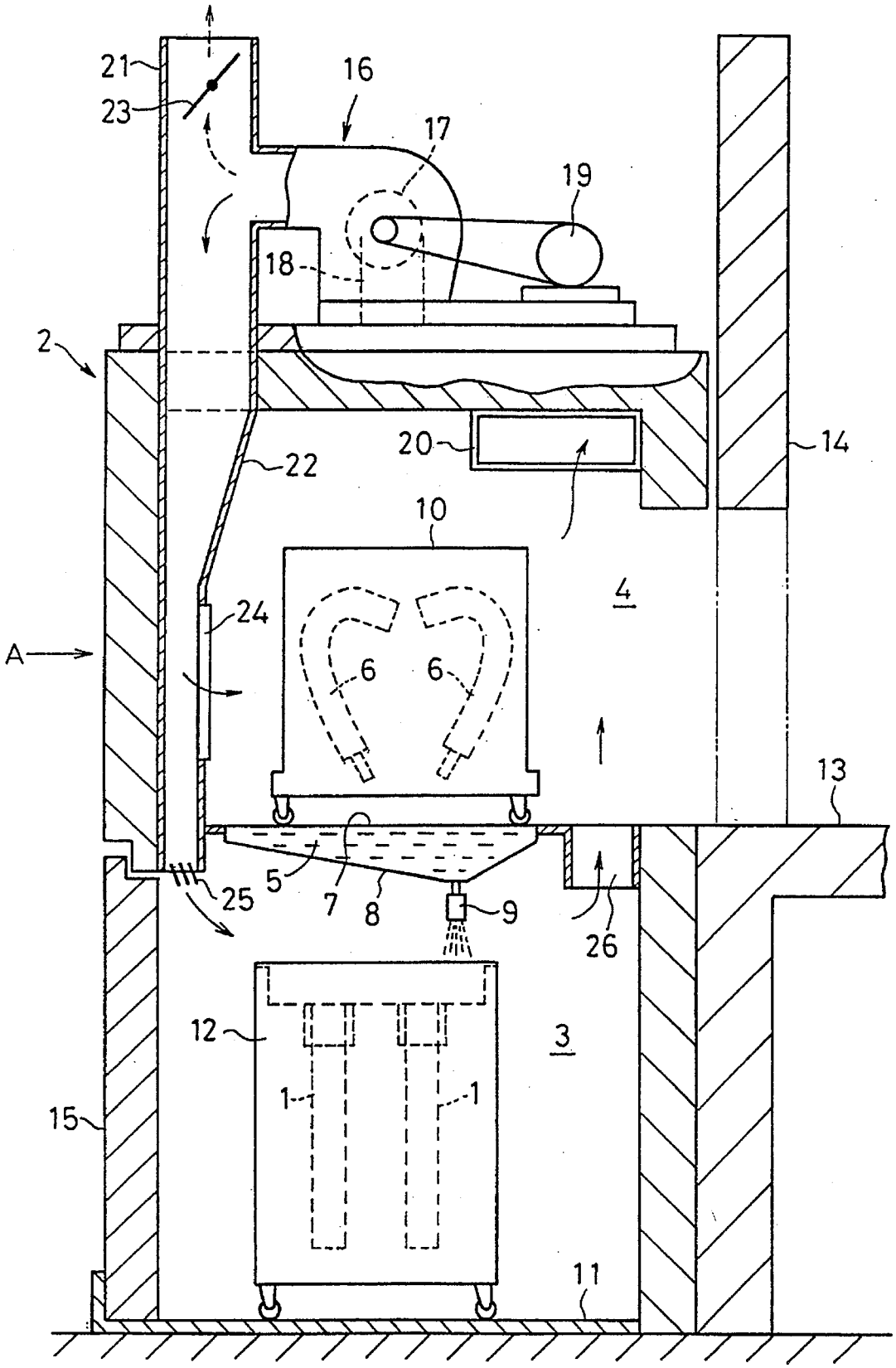
FIG. 2 is a sectional side elevation of an apparatus according to the present invention.
Figure 3:
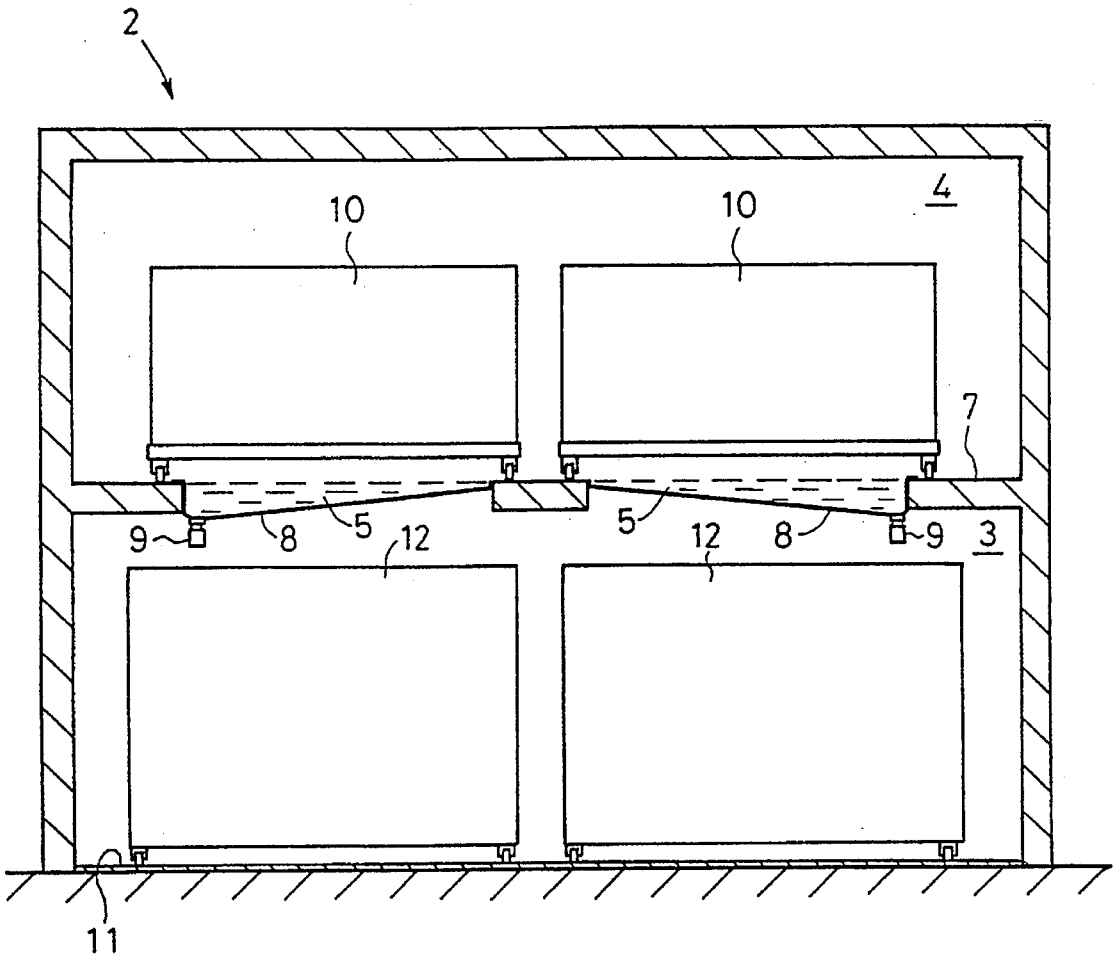
FIG. 3 is a cross-sectional view showing basic members of the apparatus according to the present invention.

FIG. 2 is a sectional side elevation schematically showing the filling and discharging furnace 2, while FIG. 3 is a cross-sectional view only showing a portion of the filling and discharging furnace 2 and a carrier therein from a front side of the filling and discharging furnace 2 (from an arrow A of FIG. 2). In these drawings, the inside of the filling and discharging furnace 2 is divided into upper and lower sections by the floor 7 of the discharging furnace 4 which is also adapted to serve as a partition wall. As illustrated in FIG. 3, two reservoirs 5 are formed in the left and right directions from the central portion of the floor 7, the bottom portions of which are designed to have slanted surfaces protruding toward the inside of the filling furnace 3. Valves 9 are provided at the lowest portion of each reservoir are valves 9 which are operable from outside by a suitable means when opened or closed.

Discharging carriers 10 are provided for carrying the bent tubular workpieces 6 on the floor 7 of the discharging furnace 4, while filling carriers 12 are provided for carrying the straight tubular workpieces 1 on a floor 11 of the filling furnace 3. Two carriers are disposed in the left and right directions in each of the discharging furnace 4 and the filling furnace 3. An upstairs bench 13 stands up from the floor 11 of the filling furnace 3 and its floor is arranged to have the same height as the floor 7 of the discharging furnace 4.

A doorway of the discharging furnace 4 which faces the bench 13 is opened and closed by a door 14 moving up and down, while a doorway of the filling furnace 3 is situated on the opposite side and opened and closed by a double-leafed hinged door 15.

Hot air circulating equipment includes a duct 16, an axial-flow fan 17 and a duct heater 18 both provided within a top portion of the filling and discharging furnace 2, wherein the axial-flow fan 17 is rotated by a motor 19. The duct 16 is provided with a suction duct 20, an exhaust duct 21 and a supply duct 22 communicating with each other.

The suction duct 20 is made to open at the upper portion of the discharging furnace 4, while the exhaust duct 21 is opened to the atmosphere to discharge the hot air fed from the axial-flow fan 17 to the atmosphere and is opened and closed by a valve 23. The opening and closing operations of the valve 23 are linked to the doors 14 and 15 and the valve 23 is arranged to quickly decrease the temperature especially within the discharging furnace 4 by opening the exhaust duct 21 to the atmosphere after filling and discharging the filling material and before opening the doors 14 and 15 so that the hot air does not blow out of the doors, when the door 14 is opened.

The valve 23 is arranged to close while the doors 14 and 15 are closed to fill and discharge the filling material.

The supply duct 22 extends vertically within the filling and discharging furnace 2 and it is adapted to supply a larger portion of the hot airflow into the discharging furnace 4 through a supply port 24 opened to the lower portion of the discharging furnace 4 and the remaining portion thereof into the filling furnace 3 through a supply port 25 opened to the upper portion of the filling furnace 3.

The inside of the discharging furnace 4 is heated by the hot air fed through the supply port 24 to the extent of 150° C. which is higher than the melting point of the filling material, while the inside of the filling furnace 3 is adjusted to keep the temperature of about 60° C. The hot airflow entered into the discharging furnace 4 through the supply port 24 heats the bent tubular workpiece 6 mounted on the discharging carrier 10 and then returns to the suction duct 20, while the hot airflow entering into the filling furnace 3 through the supply port 25 also returns to the suction duct 20 through a communicating port 26 formed at the floor 7 of the discharging furnace 4, wherein the hot air is heated again by the duct heater 18 to be circulated into the filling and discharging furnace 2.

Figure 4:
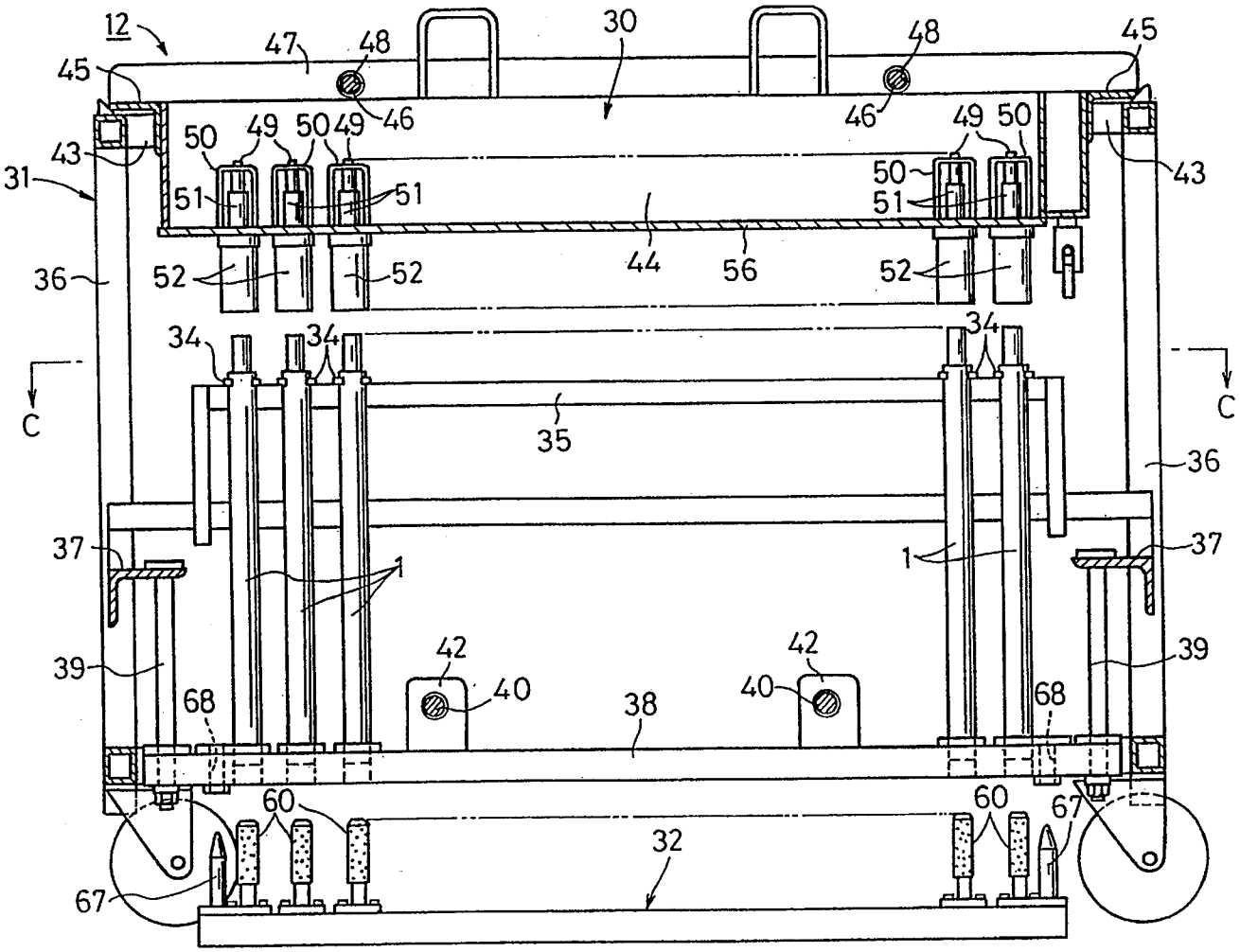
FIG. 4 is a cross-sectional view showing basic members of a filling carrier according to the present invention.

Now, the filling carrier 12 is described below in detail with reference to FIGS. 4 through 10. FIG. 4 is a cross-sectional view showing the front surface side of the filling carrier 12 from the front direction thereof (from the direction of arrow A of FIG. 2) in the condition carrying the straight tubular workpiece 1, wherein the filling carrier 12 is divided into three parts of a filling pallet 30, a carrier body 31 and a sealing pallet 32. The sealing pallet 32 is designed to move up and down by a lifter such as a hydraulic device not shown here.

Figure 5:
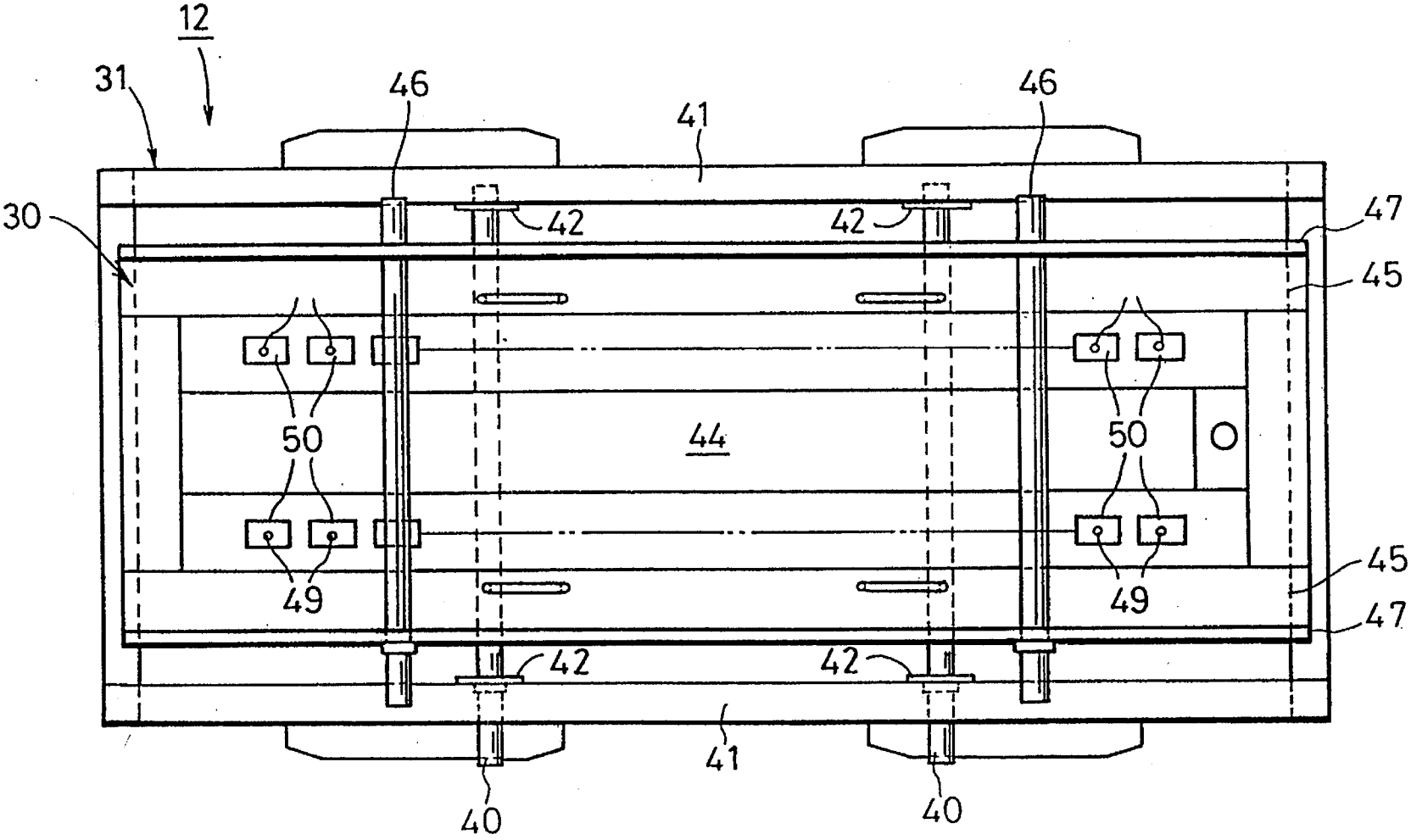
FIG. 5 is a plan view of the filling carrier according to the present invention.
Figure 6:
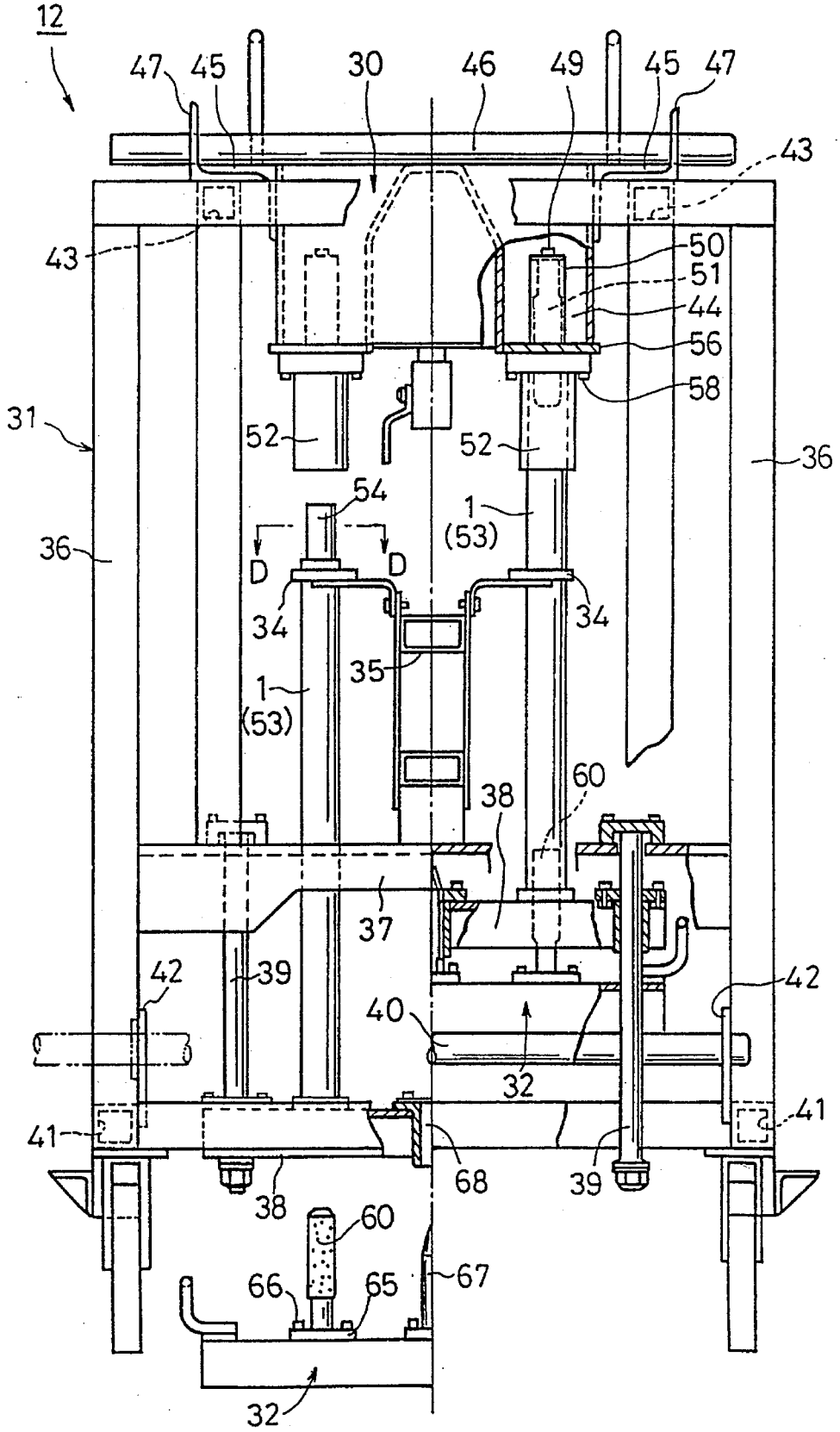
FIG. 6 is a sectional side elevation of the filling carrier according to the present invention.
Figure 7:
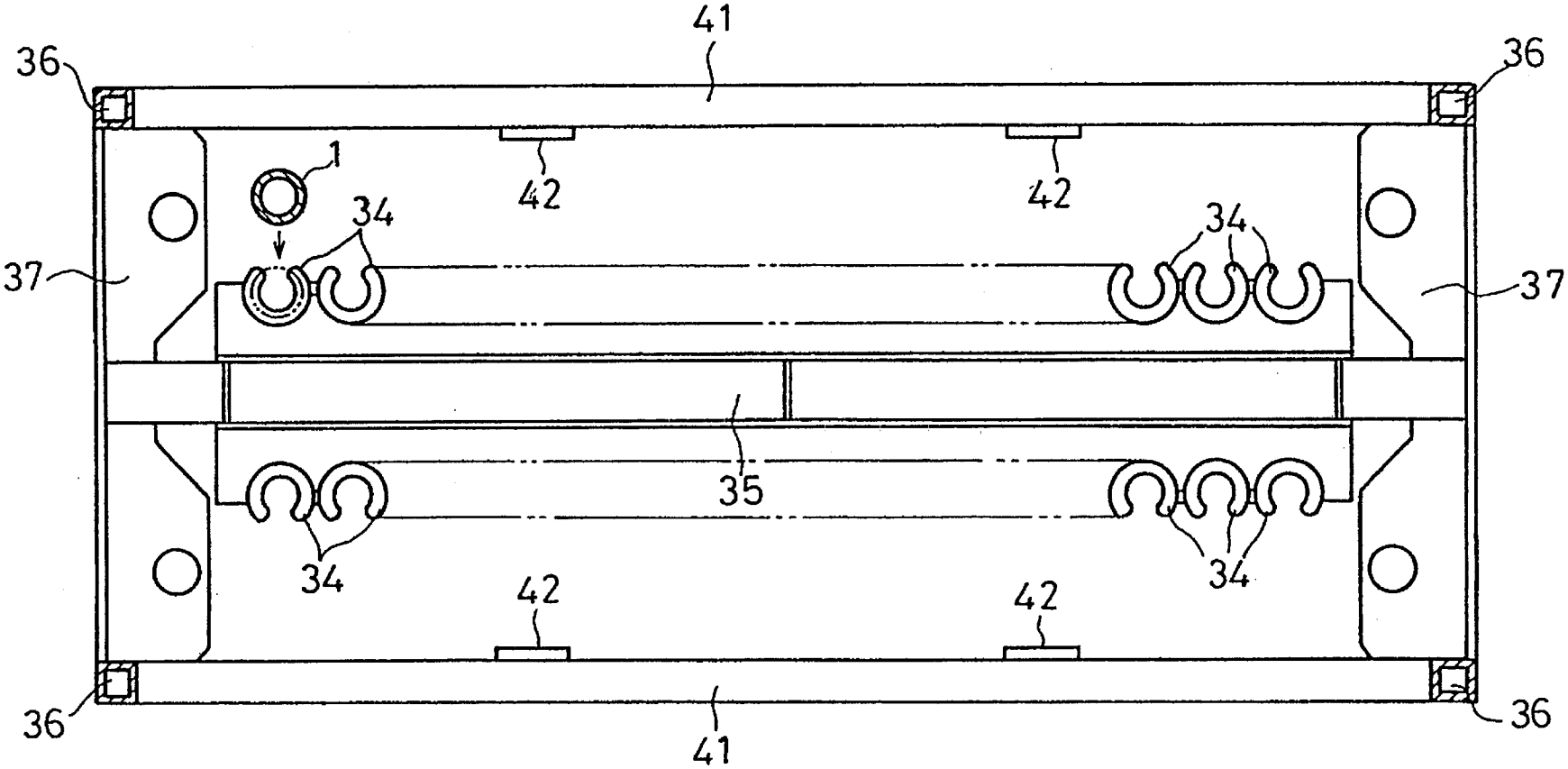
FIG. 7 is a cross-sectional view showing basic members taken along line C—C of FIG. 4.
Figure 8:
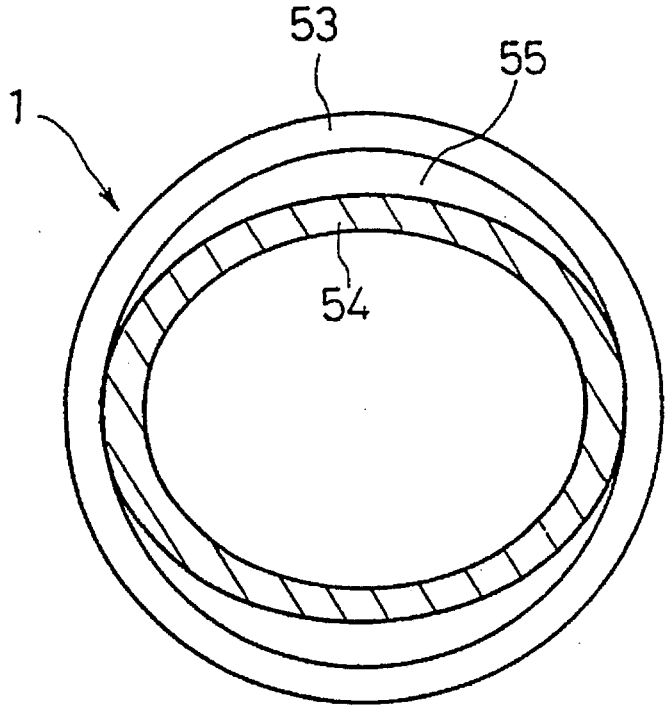
FIG. 8 is an enlarged sectional view showing basic members taken along line D—D of FIG. 6.
Figure 9:
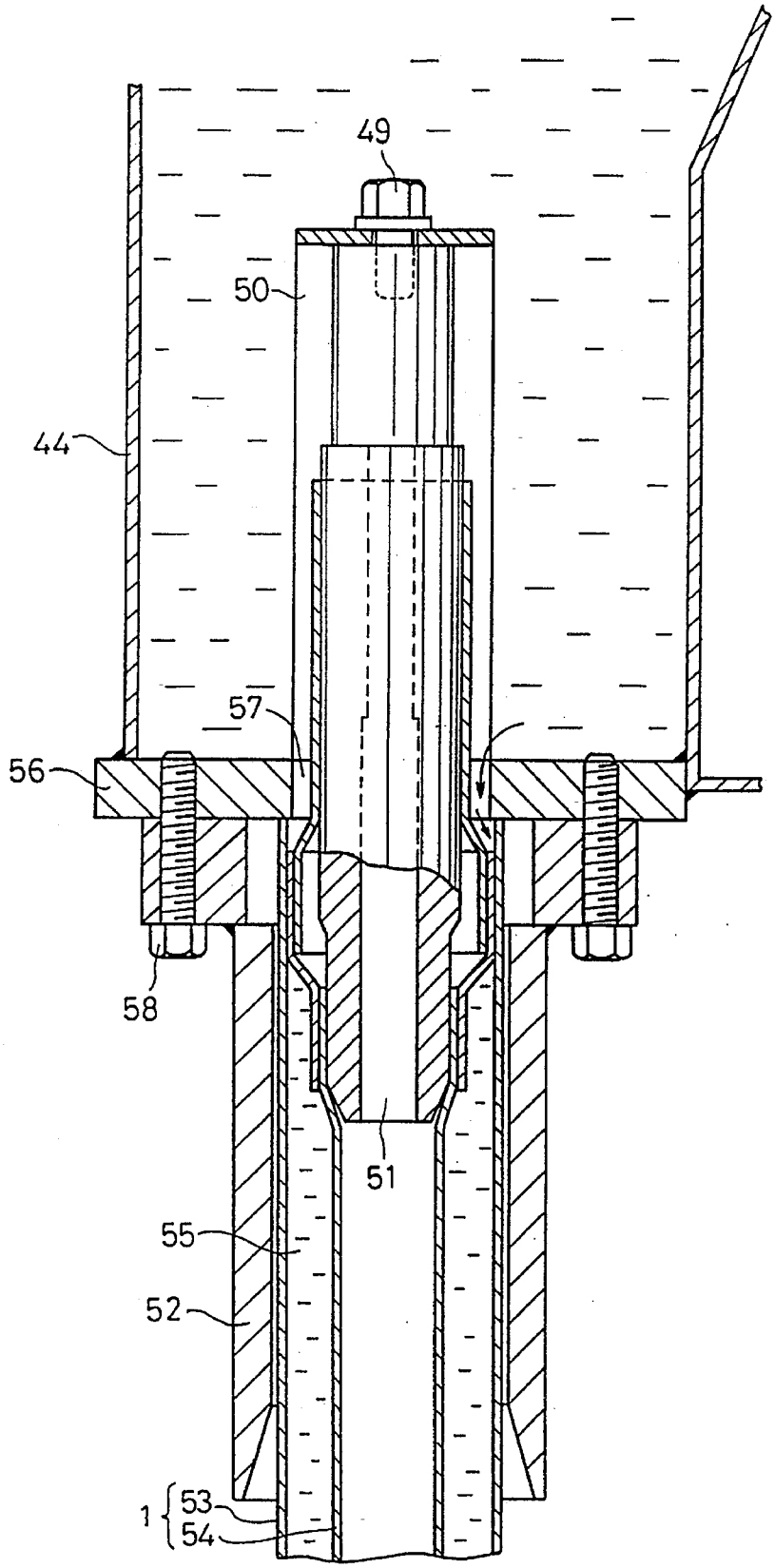
FIG. 9 is a partially enlarged sectional view showing the positioning of the various elements of the present invention relative to each other.
Figure 10:
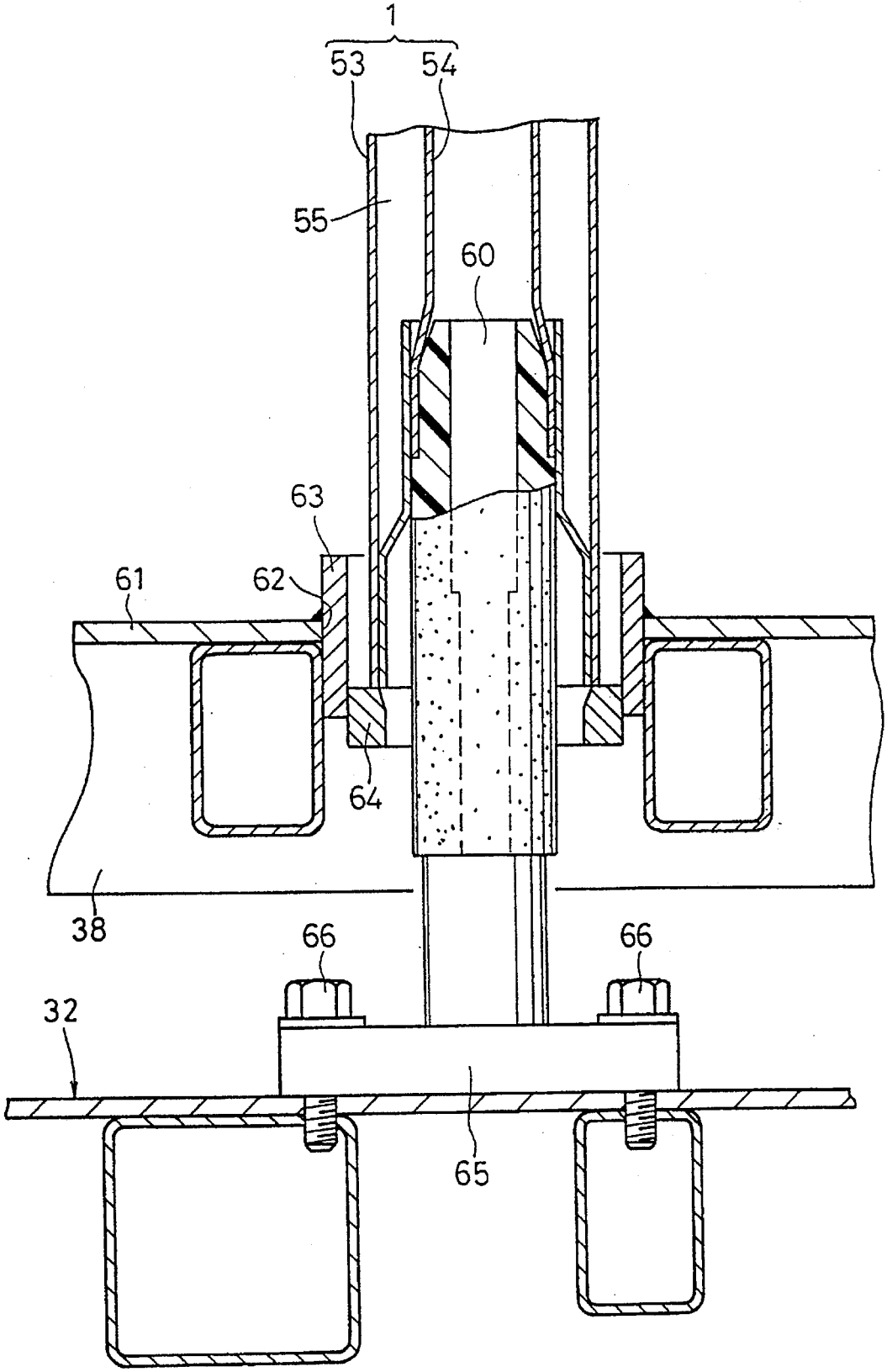
FIG. 10 is a partially enlarged sectional view showing the positioning of the various elements of the present invention relative to each other.

FIG. 5 is a plan view showing the filling carrier right before it is filled. FIG. 6 is a side elevation thereof showing the condition before setting the straight tubular workpiece 1 on the left half and the cross-section after the setting thereof on the right half, respectively. FIG. 7 is a cross-sectional view taken along line C—C of FIG. 4 and FIG. 8 is a cross-sectional view taken along line D—D of FIG. 6. FIGS. 9 and 10 are enlarged cross-sectional views showing the upper and lower end portions of the straight tubular workpiece 1 in such a set condition as shown on the right side of FIG. 6, respectively.

As is apparent from the drawings, the carrier body 31 is lined with a plurality of straight tubular workpieces 1 positioned to the right and left and supported to form two lines in the front and rear directions. This support is effected by detachably engaging the middle portion of the straight tubular workpiece 1 with a substantially C-shaped support ring 34, the circumference of which is partially cut away, as shown in FIG. 7.

The support ring 34 is also arranged to form two lines in the front and rear directions corresponding to each straight tubular workpiece 1, wherein each line is provided with a plurality of support rings 34 in the right and left directions and each support ring 34 is supported by a cross member 35 which extends in the central portion of the carrier body 31 in the right and left directions. The right and left ends of the cross member 35 are respectively secured to central portions of reinforcement members 37 extending between front and back frame members 36. The straight tubular workpiece 1 engaging with the support ring 34 is omitted from FIG. 7.

The carrier body 31 is provided at its lower portion with a slide deck 38 which is adapted to engage with the lower end portion of the straight tubular workpiece 1. The slide deck 38 is supported to move up and down through guides located in the four corners between the frame members 36. When the slide deck 38 is moved up together with the sealing pallet 32 by a lifter not shown here, it is prevented from moving down by inserting a pipe-shaped stopper 40 in the front and rear directions under the sealing pallet 32 (see FIGS. 5 and 6) and by passing each end of the stopper 40 through a bracket 42 which is provided in advance at the corresponding position of the lower right and left frame members 41 in the front and rear directions.

As is apparent from FIG. 6, the filling pallet 30 protrudes downwardly between the upper right and left frame members 43 and forms an upwardly opened receptacle-shaped portion 44, the upper end portion of which is provided at its periphery with a flange portion 45. The flange portion 45 is mounted on the upper surface of the upper right and left frame members 43, wherein the filling pallet 30 is secured by extending a stopper 46 which is similar to the stopper 40 (see FIG. 6), in the right and left directions and by passing the stopper 46 through a through bore 48 (see FIG. 4) formed on an edge portion 47 projecting upwardly from each upper end portion of the upper right and left frame members 43.

Inside the receptacle-shaped portion 44, there is provided a guide pin 51 detachably supported by a bolt 49 to a bracket 50 at a position corresponding to each straight tubular workpiece 1. The lower end portion of the guide pin 51 extends downwardly through a bottom portion of the receptacle-shaped portion 44 and is covered at its periphery by a pipe-shaped nozzle 52 which is concentrically secured to the bottom portion of the receptacle-shaped portion 44.

As is apparent from FIG. 9, the inner diameter of the nozzle 52 is almost the same as the outer diameter of the upper end portion of the outer pipe 53 of the straight tubular workpiece 1 of inner and outer double pipe construction, while the outer diameter of the guide pin 51 is almost the same as the inner diameter of the upper end portion of the inner pipe 54 which extends longer than the outer pipe 53. Accordingly, when the slide deck 38 is moved upward, the upper end portion of the straight tubular workpiece 1 is arranged such that the outer pipe 53 and the inner pipe 54 thereof engage closely between the guide pin 51 and the nozzle 52.

In this case, as is apparent from FIG. 8, the upper end portion of the inner pipe 54 is different in diameter and there is formed a clearance 55 between the outer pipe 53 and the inner pipe 54. Also, as is apparent from FIG. 9, there is formed a through bore 57 at the bottom portion 56 of the receptacle-shaped portion 44, wherein a space between the outer pipe 53 and the inner pipe 54 is adapted to communicate with the inside of the receptacle-shaped portion 44 through the through bore 57, the nozzle 52 and the clearance 55 as shown in FIG. 8. This through bore 57 allows the guide pin 51 to pass therethrough and has a larger diameter than the outer diameter of the guide pin 51, while the nozzle 52 is detachably secured through a bolt 58 to the bottom portion 56 of the receptacle-shaped portion 44.

On the other hand, the lower end portion of the straight tubular workpiece 1 is, as shown in FIG. 10, arranged such that the outer pipe 53 and the inner pipe 54 contact closely with each other. There is provided a seal member 60 made of a heat-resistant elastic body such as a silicone rubber to closely engage with the inside of the inner pipe 54 so that the seal member 60 can seal a weep hole formed on the inner pipe 54. There is further provided a through bore 62 on the upper surface panel 61 of the slide deck 38 to which a ring 63 is secured. A stopper ring 64 is also arranged to engage with the ring 63 and the lower end portion of the straight tubular workpiece 1.

Further, the seal member 60 is detachably secured at its base portion 65 to the sealing pallet 32 through a bolt 66. As is apparent from FIGS. 4 and 6, the sealing pallet 32 is provided, at the center portion of both the right and left ends, with upwardly protruding positioning pins 67 which are adapted to engage with holes 68 (see FIG. 6) formed at the position corresponding to the slide deck 38, when the sealing pallet 32 is moved upwardly.

Still further, the carrier body 31 is made to be able to carry a plurality of different kinds of straight tubular workpieces 1 with different specifications such as the inner and outer diameters and the length. When some specifications of the straight tubular workpiece 1 are changed, it is possible to cope with such changes by simply changing the nozzle 52 and the seal member 60, or the guide pin 51 in addition to the nozzle 52 and the seal member 60.

Figure 11:
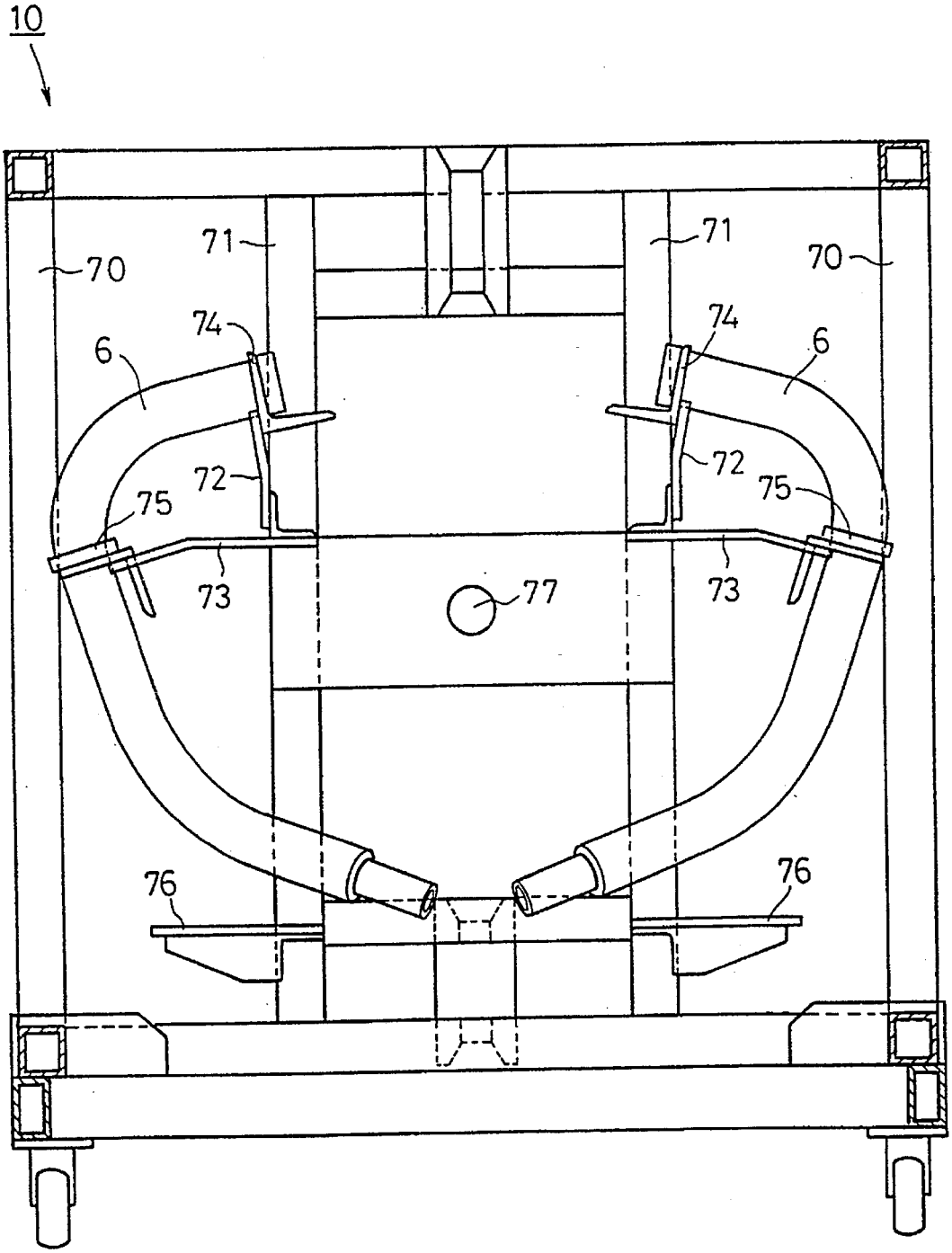
FIG. 11 is a sectional side elevation of a discharging carrier according to the present invention.
Figure 12:
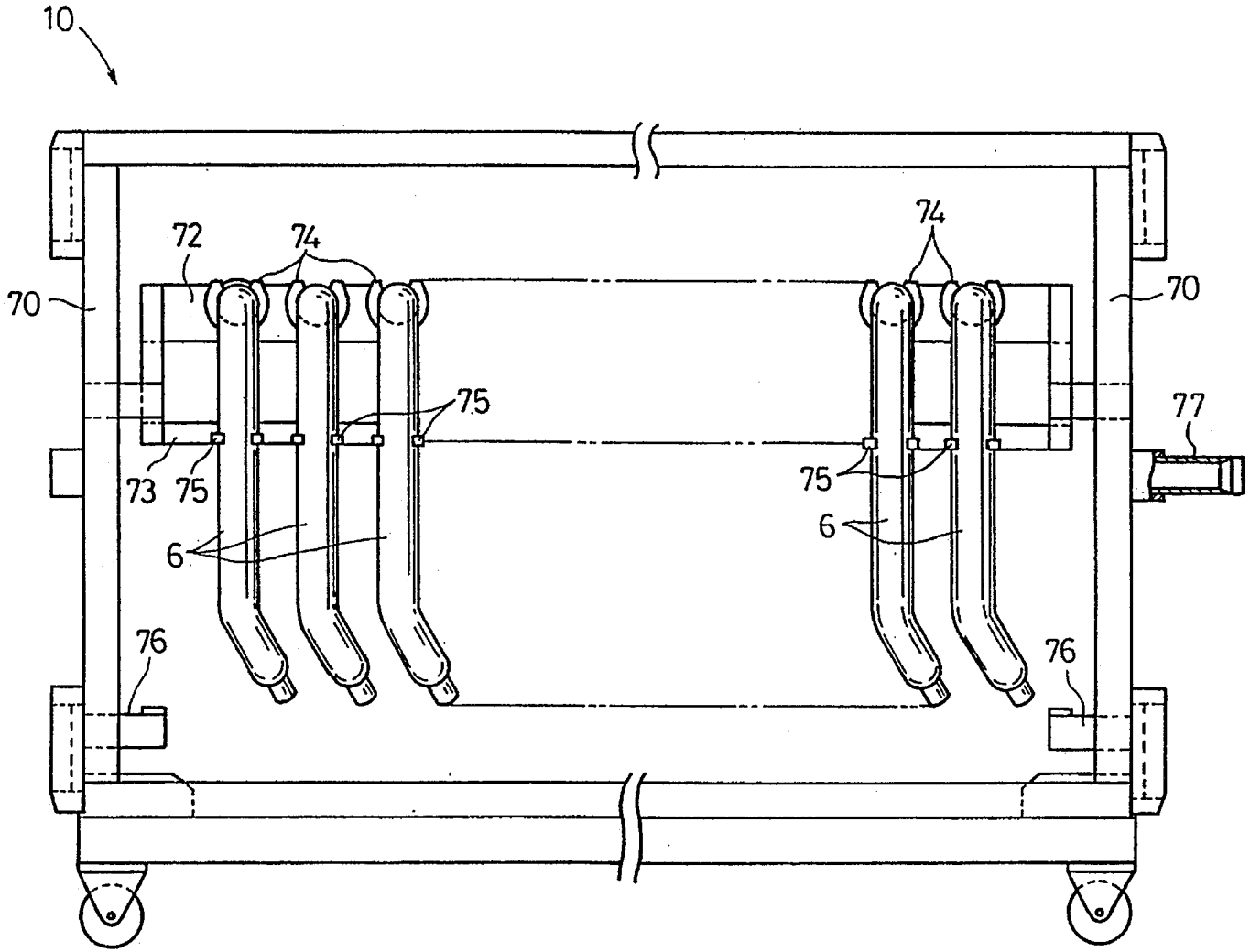
FIG. 12 is a front view of the discharging carrier according to the present invention.

FIGS. 11 and 12 illustrate a sectional side elevation and a front view of a discharging carrier 10, respectively. As shown in FIG. 11, a pair of intermediate frame members 71 on the right and left sides between the front and rear frame members 70, and supporting plates 72 and 73 extend between the right and left intermediate frame members 71. Supporting plates 72 and 73 are respectively provided with supporting rings 74 and 75 which are similar to the supporting ring 34 (see FIG. 7).

The top end of the supporting plate 72 is arranged to extend upwardly, while the top end of the supporting plate 73 extends in the front or in the rear and as a result, the supporting plates 72 and 73 are open at about 90°. Now, when the bent tubular workpiece 6 is attached to the supporting rings 74 and 75, one end portion of the workpiece 6 where the inner and outer pipes are sealed is supported and its adjacent portion is bent at about 90°, while the other end portion where the inner and outer pipes are open is supported to face downwardly. The open end portion of the inner and outer pipes is the end portion wherein the filling material is supplied.

The bent tubular workpieces 6 supported in this manner are situated in two lines in front and in rear to face each other and as shown in FIG. 12, a large number of the bent tubular workpieces 1 are lined in the right and left directions.

In FIGS. 11 and 12, an auxiliary bracket 76 is provided. In the case where the shape of the bent tubular workpiece 6 is different, another supporting plate 73 formed in a suitable shape may be attached thereto. A pin 77 is provided to which an engaging member provided at the top end of a lifting chain is retained when it is desired to lift the discharging carrier 10 for transporting.

Next, the operation of the present invention will be described below. In FIGS. 2 and 3, the discharging carrier 10 is put on the floor 7 of the discharging furnace 4, while the filling carrier 12 is put on the floor 11 of the filling furnace 3. In such a condition, when the doors 14 and 15 are closed and hot air is fed into the filling and discharging furnace 2 by the hot air circulating equipment, the inside of the discharging furnace 4 is heated to an extent of approximately 150° C. which is higher than the melting point of the filling material and the filling material filled in the bent tubular workpiece 6 of the discharging carrier 10 is now molten and discharged into the reservoir 5 because the open end portion of the bent tubular workpiece 6 is set to face downwardly (see FIG. 11). At the same time, the inside of the filling furnace 3 is kept at a temperature of about 60° C.

Now, when the valve 9 is opened, the filling material gathered within the reservoir 5 is discharged toward the filling carrier 12 situated in the lower filling furnace 3 and then received in the receptacle-shaped portion 44 of the filling pallet 30. After this, the filling material passes through the through bore 57, the upper end portion of each straight tubular workpiece 1 and the clearance 55 (see FIG. 8) and is then filled into the space between the outer pipe 53 and the inner pipe 54.

Further, in the case where the specification such as the length or the inner and outer diameters of the straight tubular workpiece 1 is changed, it is only necessary to change the nozzle 52 and the seal member 60, or the guide pin 51 in addition to the nozzle 52 and the seal member 60, without changing the carrier body 31. Accordingly, the alteration of the filling carrier 12 resulting from the change of specifications of the straight tubular workpiece 1 is controlled as low as possible and it is therefore no longer necessary to maintain many kinds of filling carriers 12 which have been exclusively prepared for each of the specifications of the straight tubular workpiece 1. It is also possible to save the cost for such carriers and the space for stocking thereof.

Still further, since one carrier 10 or 12 is adapted to carry many straight tubular workpieces 1 or many bent tubular workpieces 6 and two units each of the carriers 10 and 12 are put into the filling and discharging furnace 2 at a time, it is possible to remarkably improve the working efficiency.

Since the carrier body is not provided with the seal member and even if the hot straight tubular workpiece right after welding is supported thereon, there is not a possibility wherein the seal member is damaged by the heat.

Moreover, since one filling and discharging furnace 2 is utilized in three dimensions to have the filling furnace 3 and the discharging furnace 4 arranged in the upper and lower positions thereof, it is possible to effect the filling of the filling material as well as the melting and discharging thereof at the same time, reduce the working space sharply and improve the working efficiency. Also, since the conventional reservoir for maintaining the heat for the discharged liquid is no longer needed, it is not only possible to save the heat keeping energy of the filling material (the discharged liquid), but also make the construction of the equipment simple and compact, and increase the degree of freedom in the equipment layout.

Also, since the hot air is circulated within the discharging furnace 4 by the hot air circulating equipment, it is possible to utilize the heat effectively and expedite the rising of the temperature when heated. Further, since the inside of the filling furnace 3 is also adapted to be kept warm by utilizing a portion of the hot air fed into the discharging furnace 4, it is also possible to save the heat keeping energy.

The present invention is not limited to the above embodiments, but may be modified and changed without departing from the scope and spirit of the invention. For example, the workpiece can be a multiple pipe over three layers and to the contrary, it may not be a multiple pipe.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for filling and discharging a filling material comprising the steps of:

providing a single filling and discharging furnace including a lower filling furnace and an upper discharging furnace having a reservoir formed in a floor thereof;

moving a workpiece into the lower filling furnace;

supplying a filling material of a low melting point into the workpiece;

bending the workpiece to form a bent workpiece;

moving the bent workpiece into the upper discharging furnace;

heating the bent workpiece to melt and discharge the filling material; and collecting melted and discharged filling material in the reservoir formed in the floor of the upper discharging furnace for subsequent supplying of the filling material into a workpiece disposed in the lower filling furnace.

2. A filling and discharging furnace for supplying a filling material to a workpiece comprising:

a discharging furnace for melting and discharging the filling material of low melting point from a bent workpiece after bending;

a filling furnace for supplying the filling material into a workpiece before bending;

said discharging furnace and said filling furnace being arranged in the upper and lower portions, respectively, of the filling and discharging furnace;

hot air circulating equipment provided for communicating with the discharging furnace and the filling furnace, wherein the majority of the hot airflow is fed into the discharging furnace and the remaining portion thereof is fed into the filling furnace; and a reservoir provided in a floor of the discharging furnace for gathering the filling material molten and discharged onto the floor and having a valve operatively connected thereto, wherein the gathered filling material is released through the valve of the reservoir into the filling furnace.

3. The filling and discharging furnace for supplying a filling material to a workpiece according to claim 2, wherein the hot air circulating equipment includes an exhaust duct of a valve operation type adapted for releasing hot air within the discharging furnace to the atmosphere, a first supply port for supplying the hot airflow into the discharging furnace, and a second supply port for supplying the hot airflow into the filling furnace, wherein the opening and closing operations of the valve of the exhaust duct are arranged to be linked with the opening and closing operations of doors respectively provided at the discharging furnace and the filling furnace for allowing the workpieces to go in and out thereof.

4. The filling and discharging furnace for supplying a filling material to a workpiece according to claim 2, wherein the bottom portion of the reservoir is formed on an inclined surface protruding towards the lower filling furnace.

5. The filling and discharging furnace for supplying a filling material to a workpiece according to claim 2, wherein a filling carrier is disposed in the filling furnace adjacent to the Valve formed at the bottom portion of the reservoir for supplying the filling material into the workpiece.

6. The filling and discharging furnace for supplying a filling material to a workpiece according to claim 2, wherein a plurality of workpiece carrying carriers are accommodated in the filling furnace and the discharging furnace at the same time.

7. A filling carrier of a filling material for bending for supplying a filling material while supporting a workpiece prior to bending, comprising:

a carrier body;

a filling pallet disposed at the upper portion of the carrier body; and a sealing pallet disposed at the lower portion of the carrier body;

said carrier body being provided with a slide deck adapted to move up and down in a condition which vertically supports the workpiece;

the filling pallet being made in the form of an upwardly opened receptacle for holding the filling material in a molten condition and provided with a nozzle which is arranged to protrude downwardly to the periphery of a through bore formed at the bottom of the receptacle and which has an inner diameter substantially equivalent to an outer diameter of the workpiece, the upper portion of which is adapted to engage with the nozzle when moved upwardly; and said sealing pallet being disposed to move up and down and provided with a seal member which has an outer diameter substantially equivalent to an inner diameter of the workpiece, the lower portion of which is adapted to engage with the seal member when the sealing pallet is moved upwardly.

8. The filling carrier of a filling material for bending a workpiece according to claim 7, wherein the filling body is designed to support a plurality of workpieces and a single filling pallet is provided with a plurality of nozzles, while a single sealing pallet is provided with a plurality of seal members, so that the nozzles and seal members can be disposed to correspond to the plurality of the workpieces, respectively.

9. The filling carrier of a filling material for bending a workpiece according to claim 7, wherein the workpiece and the bent workpiece are detachably supported at their peripheries to the side of the carrier by engaging members which are susceptible to elastic deformation.

10. The filling carrier of a filling material for bending a workpiece according to claim 7, wherein the slide deck is lifted as the sealing pallet is lifted and allows the upper end portion of the workpiece to be connected to the nozzle and the opening of the lower end portion thereof to be sealed with the sealing member.

11. The filling carrier of a filling material for bending a workpiece according to claim 10, wherein the nozzle and the sealing member are replaceable in response to a change in the specification of the workpiece.

12. The filling carrier of a filling material for bending a workpiece according to claim 10, wherein the sealing pallet is lifted by a lifter separately provided from the carrier body.

13. The filling carrier of a filling material for bending a workpiece according to claim 7, wherein the sealing pallet is secured by a stopper means to the lower portion of the slide deck when lifted.

14. The filling carrier of a filling material for bending a workpiece according to claim 7, wherein the filling pallet is detachably secured to the carrier body by a stopper.

15. The filling carrier of a filling material for bending a workpiece according to claim 14, wherein the filling pallet is provided with a detachably mounted guide pin which is adapted to engage with the inside of the upper end portion of the workpiece with a clearance formed therebetween and the guide pin is disposed to be concentric with the nozzle.

* * * * *